United States Patent [19]

Baker

[11] 4,173,090

[45] Nov. 6, 1979

[54] CYLINDER-LOCKING DEVICE FOR REVOLVERS

[75] Inventor: Richard L. Baker, Granby, Conn.

[73] Assignee: High Standard, Inc., East Hartford, Conn.

[21] Appl. No.: 905,043

[22] Filed: May 11, 1978

[51] Int. Cl.[2] ..... F41C 1/00

[52] U.S. Cl. ..... 42/67

[58] Field of Search ..... 42/67, 65

[56] References Cited

U.S. PATENT DOCUMENTS

| | | | |
|---|---|---|---|
| 818,075 | 4/1906 | Bye | 42/67 |
| 2,958,151 | 11/1960 | Sefried | 42/67 |
| 3,187,454 | 6/1965 | Geber | 42/67 |
| 3,996,686 | 12/1976 | Baker | 42/65 |
| 4,001,962 | 1/1977 | Baker | 42/67 |

*Primary Examiner*—Charles T. Jordan

*Attorney, Agent, or Firm*—St. Onge, Steward, Johnston, Reens & Noë

[57] ABSTRACT

A cylinder lock for a cartridge cylinder of a revolver in which an actuator is mounted on the trigger in such a way that when the trigger is pulled, the cylinder lock is retracted from locking engagement with the cylinder by means of a toggle action, thereby providing great mechanical advantage in overcoming a heavy cylinder-lock spring which holds the lock in engagement with the cylinder. The actuator is also arranged so that the cylinder-lock spring is not compressed during the return stroke of the trigger.

8 Claims, 4 Drawing Figures

CYLINDER-LOCKING DEVICE FOR REVOLVERS

BACKGROUND OF THE INVENTION

This invention relates to firearms, and it relates more particularly to cylinder-locking devices for revolvers and to actuating means for unlocking the cartridge cylinder so that it can be indexed while the hammer is being cocked.

The cylinder in a revolver is rotated through a predetermined angle of rotation by means of a pawl and ratchet arrangement, the pawl or cylinder hand, as it is sometimes called, being actuated when the trigger is pulled to engage a tooth of the ratchet located on the rear face of the cylinder. As each cartridge chamber in the cylinder is brought into alignment with the bore in the barrel of the revolver by means of the pawl and ratchet, it is locked in such aligned position while the cartridge is fired and, upon return of the trigger to its forward position, the pawl is returned to its initial position where it is ready to engage the next ratchet tooth, whereby the cylinder is successively indexed from one cartridge chamber to the next each time the trigger is pulled.

In order to stop the cylinder as each chamber is brought into alignment with the barrel and to hold it in such alignment until the trigger is pulled again, a cylinder stop or lock retractably mounted in the frame of the revolver moves into locking engagement with one of a series of stop notches provided on the periphery of the cylinder. When the trigger is pulled, the cylinder lock is first retracted from one of the stop notches in the cylinder to permit the cylinder to be rotated and, when the cylinder is indexed through the required number of degrees, the lock is again moved into engagement with the next stop notch to hold the cylinder in the next position. The cylinder lock remains thus engaged when the gun is fired and when the trigger is released, therby preventing rotation of the cylinder at all times except while it is being indexed from one chamber to the next.

As a general rule it is desirable to provide the cylinder lock with a relatively heavy spring for urging it into locking engagement with the cylinder, both to prevent throw-by of the cylinder when it is indexed rapidly from one chamber to the next and to prevent accidental release of the cylinder when the revolver is not actually being fired. Furthermore, use of a heavy cylinder-lock spring is particularly desirable in a cylinder-indexing system disclosed in the U.S. patent to Baker U.S. Pat. No. 4,001,962, for which the present cylinder-locking device was more particularly designed, because of the unique camming action of the lock on the cylinder employed in the Baker system which assures accurate indexing of the cylinder.

Typical cylinder locks which work in the manner outlined above are disclosed in the U.S. patents to Sefried U.S. Pat. No. 2,958,151, and to Baker U.S. Pat. Nos. 3,996,686 and 4,001,962.

However, in all prior cylinder-locking systems of which I am aware, the heavier the locking spring is, the greater the force required to return the trigger from its firing position to its rest position. This is due to the fact that the locking spring usually has to be compressed during the return stroke of the trigger, and revolvers which have been provided with a heavy locking spring have necessarily had to employ a rather heavy trigger-return spring. The obvious disadvantage of this is that the trigger pull is undesirably heavy. While the existence of a heavy trigger spring may not be particularly important in some double-action revolvers because of the great force required in cocking the hammer by means of the trigger, it is a distinct disadvantage where the revolver can be fired—even in double action—by means of only a relatively light trigger-pull. Moreover, when firing in single-action, it is of course particularly desirable for shooting accuracy to provide a smooth and relatively light trigger-pull.

As a practical matter, therefore, in order to obtain the desired trigger-pull, it has been necessary to reduce the strength of the cylinder-locking spring below what would otherwise be desirable for functional, as well as safety, purposes. An important object of the present invention is to provide a way of unlocking the cartridge cylinder of a double-action revolver, which does not interfere with the return of the trigger to its rest position, so that a much heavier cylinder-lock spring can be used.

On the other hand, even in those rare cases where a separate trigger spring is unnecessary, use of a heavy cylinder-lock spring usually resulted in an unacceptable trigger-pull. It is accordingly an object of this invention to provide sufficient mechanical leverage between the trigger and the cylinder lock by means of a toggle action for overcoming the pressure of a heavy cylinder-lock spring when the lock is retracted by the trigger in order to release the cylinder for indexing.

These and other objects and advantages of the invention will become more readily apparent from the specific description hereinafter of one embodiment of the invention.

SUMMARY OF THE INVENTION

The cylinder-locking device of the present invention is employed in connection with a revolver having the usual cartridge cylinder and trigger which indexes the cylinder each time the gun is fired. The trigger is pivoted on a trigger pin in the frame of the revolver for movement between a rest position and a firing position. A cylinder lock is likewise pivotally mounted on the frame for movement into and out of locking engagement with the cylinder and is resiliently urged into such locking engagement. An actuator is pivotally mounted on the trigger for interaction with a working surface on the cylinder lock in such a way that as soon as the trigger is pulled, a nose portion on the actuator presses against the working surface, pivoting the cylinder lock out of engagement with the cylinder. To this end, the pivot point for the actuator is located between the trigger pin and the point at which the cylinder lock is pivoted. In addition, with the trigger is in its rest position, the actuator pivot point is disposed out of alignment with the points about which the trigger and cylinder lock pivot, such that when the trigger is pulled, the actuator pivot point is moved toward alignment of the three pivot points, thereby producing a toggle action. Great mechanical advantage is therefore obtained by the trigger with respect to the cylinder lock for overcoming the pressure of the spring which urges the cylinder lock into locking engagement with the cylinder.

After the cylinder is unlocked and has been rotated in the usual manner as the trigger is being pulled further toward the firing position, the nose portion of the actuator pivots out of engagement with the working surface on the cylinder lock, permitting the lock to move back into engagement with the cylinder for locking the cylinder in the next position to which it is indexed. Consequently, on the return stroke of the trigger following discharge of a cartridge, the actuator simply slides along the cylinder lock until just before the trigger reaches its rest position when the nose of the actuator again comes into position for re-engagement with the working surface.

Preferably, means are provided for positively camming the actuator out of engagement with the working surface on the cylinder lock at a particular point during the movement of the trigger, so that the cylinder lock is permitted to re-engage the cylinder just before the cylinder is fully indexed at the point where it will come in contact with the lead-in ramp to the cylinder notch. Such cam means may consist, for example, of a portion of the cylinder lock itself immediately adjacent the working surface. Thus, where the working surface is formed by one wall of a notch in the cylinder lock, the other side of the notch may form a hump which provides the means for camming the actuator out of the notch as the cylinder lock and trigger pivot relative to each other during the cylinder-releasing portion of the trigger movement.

DETAILED DESCRIPTION OF THE PREFERRED EMBODIMENT OF THE INVENTION

In the accompanying drawings.

Figure 1:
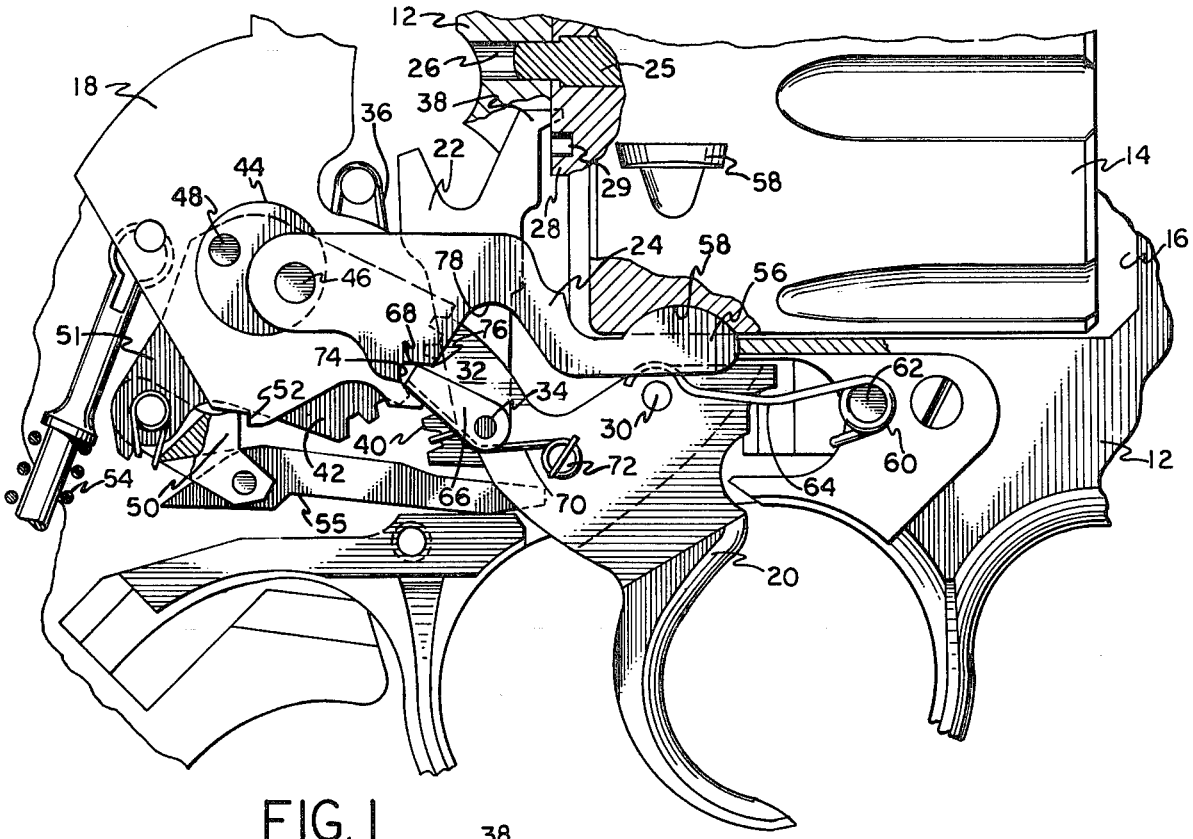
FIG. 1 is a fragmentary side elevational view, partially broken away and in section, of the double-action mechanism for a revolver with the cylinder-locking device of the present invention.

The cylinder locking device of the present invention is disclosed for convenience sake in connection with the revolver shown and described in the hereinbefore-mentioned patents to Baker U.S. Pat. Nos. 3,996,686 and 4,001,962, but its application is of course not limited to revolvers of that particular design. The revolver consists basically of a frame 12, a cartridge cylinder 14 rotatably mounted within a central opening 16 of frame 12, a hammer 18, a trigger 20, a cylinder indexing pawl or hand 22 and a cylinder lock 24. Cylinder 14 rotates on a spindle 25, the rear end of which protrudes a short distance from the rear face of cylinder 14 for engagement within a passage 26 in the center of frame 12.

A ratchet wheel 28 is integrally formed concentrically on the rear face of cylinder 14 and has a plurality of radially disposed teeth 29 (shown diagrammatically in FIG. 1) which are engaged by the indexing hand 22 in sequence for rotating cylinder 14 each time the gun is to be fired, in order to index the cartridge chambers sequentially into alignment with the gun barrel (not shown).

Trigger 20 is pivoted on frame 12 about a trigger pin 30 for actuation in the usual manner. Cylinder hand 22 is pivotally connected at its lower end to a rearwardly and upwardly projecting portion 32 of trigger 20 by a pivot pin 34 and is resiliently urged forward at its upper end by means of a torsion spring 36 for engagement of its nose 38 with ratchet 28. Each time trigger 20 is pulled, hand 22 is raised, indexing cylinder 14 to move the next chamber into alignment with the barrel.

A gear-segment 40 on the rear portion 32 of the trigger meshes with the teeth of a gear-plate 42 on hammer 18 for pivoting the hammer into its cocked position. In this instance, hammer 18 is pivoted on a circular eccentric-plate 44, which in turn is eccentrically pivoted on a hammer pin 46. Gear-plate 42 is connected by means of a clevis pin 48 to eccentric-plate 44 for pivotal movement therewith about hammer pin 46. In order to retract the hammer by means of the trigger in double-action, a sear 50 is pivoted to a projection 51 on the lower rear portion of gear-plate 42 in position for locking engagement with a sear-notch 52 on the lower edge of hammer 18. As the trigger is pulled (clockwise as shown in the drawings), pivoting gear-plate 42 counterclockwise about hammer pin 46, the sear 50 engages notch 52 in the hammer so that the hammer is pivoted counterclockwise with gear-plate 42 against the pressure of a hammer spring 54. Shortly before the trigger reaches its fully retracted or firing position, a finger 55 extending forwardly from seat 50 engages a fixed abutment (not shown), and pivots sear 50 clockwise, so that the sear is disengaged from sear-notch 52, freeing hammer 18 to pivot on eccentric-plate 44 under the pressure of the hammer spring.

It will be noted that as the hammer is cocked in double-action, the cylinder hand 22 indexes cylinder 14 before the hammer is released. As shown in the beforementioned Baker patents, means (not shown) are also provided for firing in single-action, in which case the trigger is pivoted clockwise by the hammer to a single-action position, actuating cylinder hand 22 in order to index the cylinder when the hammer is cocked manually.

Cylinder lock 24 is an elongated, goose-necked member which performs the usual function of locking cylinder 14 in each of the positions to which it is indexed for discharge of a cartridge. In this instance, however, lock 24 is mounted at one end on hammer pin 46 for pivotal movement only, and extends forwardly under cylinder 14 where it is provided with a cylinder-engaging head portion 56, which fits in sequence into each of the usual stop notches 58 on the outer-surface of cylinder 14. Notches 58 are equally spaced circumferentially about the periphery of the cylinder and are each disposed with respect to a corresponding cartridge chamber, such that when each of the cartridge chambers is aligned with the barrel, cylinder lock 24 is fully engaged within one of the notches 58.

Figure 3:
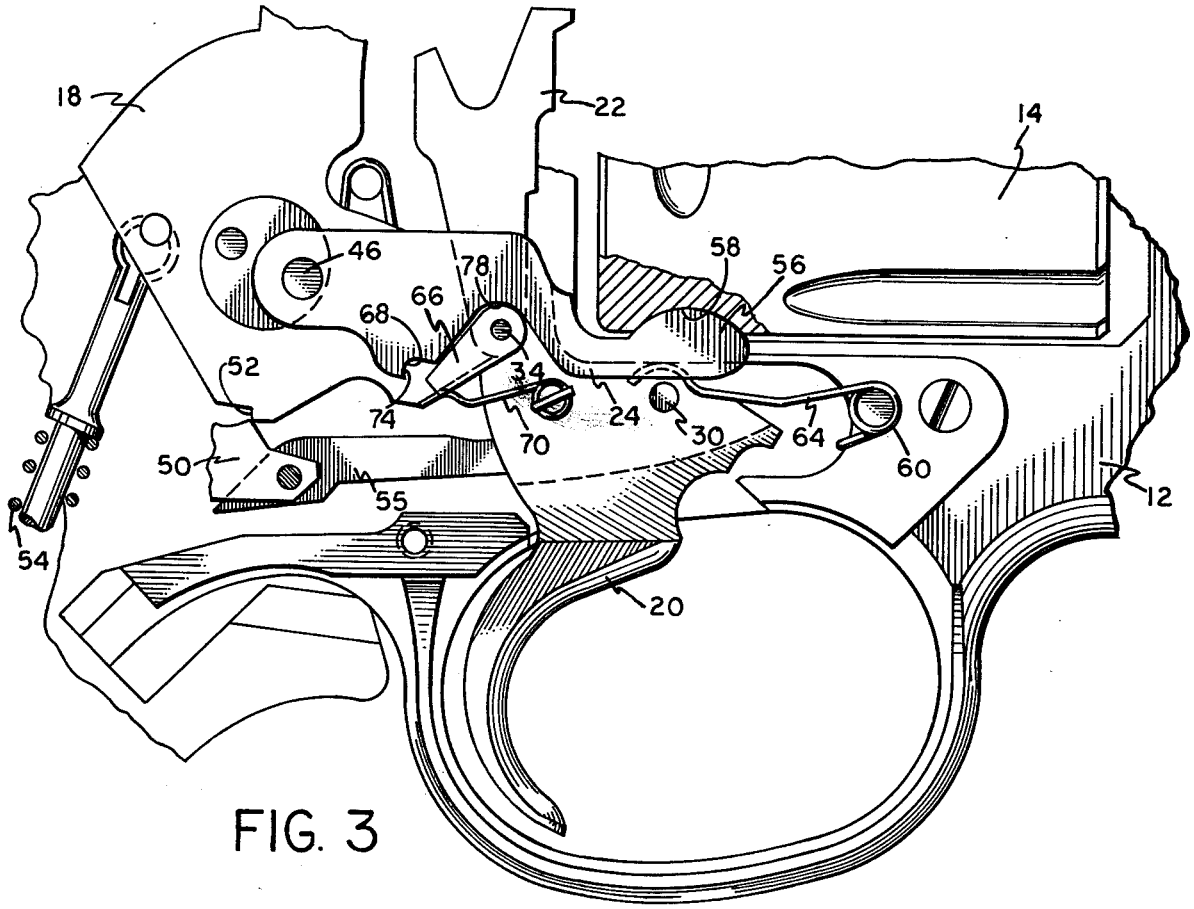
FIG. 3 is another view similar to FIG. 1, showing the parts in the position they assume when the trigger is in its firing position.

A torsion spring 60 supported on a stud 62 on frame 12 has one end 64 which extends rearward into engagement with a groove in the under edge of the cylinder-engaging portion 56 of lock 24. The other end of spring 60 is anchored on a shoulder of the frame so that cylinder lock 24 is urged by the long end 64 in a counterclockwise direction into locking engagement with the cylinder, as shown in FIGS. 1 and 3. In addition to locking the cylinder in position, cylinder lock 24 is also provided with a cam-surface (not shown) on the upper edge of its cylinder-engaging portion 56 for camming the cylinder into fully indexed position as disclosed in the aforementioned patent to Baker U.S. Pat. No. 4,001,962.

In accordance with the present invention, a cylinder-lock actuator 66 is pivoted on trigger 20 about the pivot pin 34 for engagement within a notch 68 in the under edge of cylinder lock 24. Actuator 66 is resiliently urged in a clockwise direction by a torsion spring 70, which is supported on a stud 72 on the trigger. One end of spring 70 is anchored on stud 72, while the other end extends under actuator 66 and rides in a groove that runs from adjacent pivot pin 34 to the nose of the actuator at its free end.

When trigger 20 is in its position of rest as illustrated in FIG. 1, the free end or nose of actuator 66 is disposed within notch 68 so that when the trigger is pulled, it moves rearward into engagement with a working surface 74 of notch 68. Continued movement of the trigger in a clockwise direction drives actuator 66 against surface 74, pivoting cylinder lock 24 in a clockwise direction, as more fully described hereinafter. During the initial portion of such movement, cylinder lock 24 is rapidly retracted out of cylinder notch 58 in order to release cylinder 14 so that it can be rotated by the indexing hand 22. Further movement of the trigger causes the actuator to pivot out of engagement with the surface 74 so that the cylinder lock can again lock the cylinder.

Figure 4:
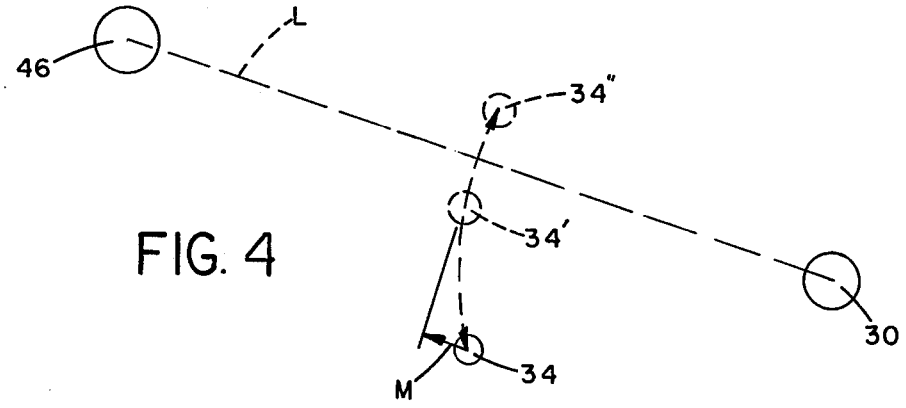
FIG. 4 is a diagram showing the movement of the actuator pivot pin relative to the fixed trigger and hammer pins.

FIG. 4 shows the relationship, as the trigger is being pulled, of the actuator pivot pin 34 to the trigger pin 30 and hammer pin 46, both of which are fixed. In FIG. 4 pivot pin 34 is shown in full lines in the position corresponding to FIG. 1 when the trigger is in its rest or normal position. When the trigger is pulled, pin 34 moves to the broken-line position 34' corresponding to its position in FIG. 2, and finally to the position 34'' at the end of the firing stroke of the trigger when the revolver is fired in double-action. Retraction of cylinder lock 24 results from the toggling or buckling action of the trigger, cylinder lock and actuator, as the pin 34 shifts in a direction designated by the arrow M parallel to an imaginary line L between the trigger pin 30 and the hammer pin 46. It should be noted that the component of movement M is greatest just as the trigger is moved out of its rest position, and consequently release of the cylinder is accomplished immediately upon pulling the trigger. Furthermore, since the component of movement M rapidly diminishes to zero as pin 34 approaches the line L, further retraction of cylinder lock 24 once it is free of notch 58 is insignificant, thereby ensuring immediate re-engagement of lock 24 with the cylinder when actuator 66 releases the cylinder lock.

It will also be apparent from the drawings that there is a significant relationship between the pivot pins 30, 34 and 46, the length of actuator 66 and the position of the working surface 74 on the cylinder lock 24. Thus, in order to provide the buckling or toggling action desired, it is essential that the distance between the centers of pivot pins 30 and 46 be less than the sum of the distances between (a) the centers of the pivot pins 30 and 34, (b) the center of pivot pin 34 and the extremity of the nose portion of actuator 66, and (c) the working surface 74 and the center of hammer pin 46. Due to the toggle action produced immediately upon starting to pull the trigger, only a slight additional force on the trigger is required to compress cylinder-lock spring 60, even when this spring is a relatively heavy one. The so-called "trigger-pull" required to release the cylinder is accordingly kept to a bare minimum.

Furthermore, due to the fact that cylinder lock 24 is pivoted on the hammer pin 46, it can be made long enough to provide sufficient movement of its cylinder-engaging head 56 to move it completely out of the path of the cylinder 14 by means of a comparatively small amount of movement at the working surface 74. Thus, the surface 74 is desirably located closer to the hammer pin 46 than it is to the opposite end of cylinder lock 24. In addition, by disposing the cylinder lock so that its pivoted end is located rearwardly of the actuator 66 and by extending it forwardly thereof into operative relationship with the cartridge cylinder, it is positioned such that it can be readily engaged by the nose of the actuator 66 for retracting it from locking engagement with the cylinder. As will be more apparent hereinafter, disposition of the cylinder lock 24 in this manner also makes it possible to use the actuator 66 for a secondary purpose in driving the lock into rigid engagement with the cylinder after the nose of the actuator has released the lock, all as illustrated in FIG. 3.

Figure 2:
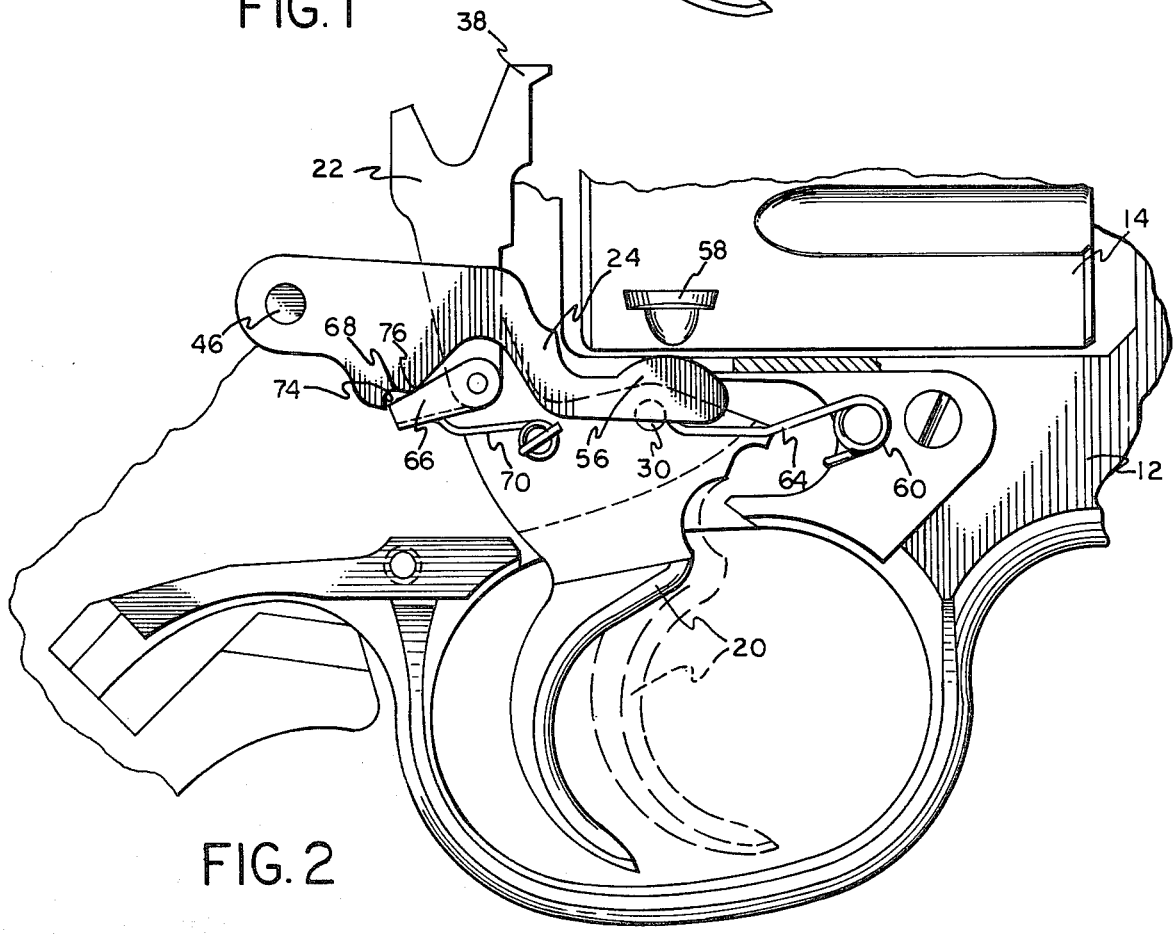
FIG. 2 is a view similar to FIG. 1, but showing the trigger pulled to the position where the cylinder lock is fully disengaged from the cylinder and is about to be released for re-engagement with the cylinder as the trigger is pulled slightly further.

In order to permit cylinder lock 24 to re-engage the cylinder in time to lock it at the next position to which it is indexed, actuator 66 is cammed counterclockwise, as shown in FIG. 2, until its nose is out of engagement with the working surface 74 on the cylinder lock 24. To this end, a hump 76 on cylinder lock 24, adjacent the upper edge of notch 68 and opposite the working surface 74, engages the upper side of actuator 66. As cylinder lock 24 is pivoted downward and the rear portion 32 of trigger 20 moves upward, hump 76 cams the nose of actuator 66 down to the position shown in FIG. 2, where it is about to slip off the working surface 74 completely, freeing the cylinder lock to re-engage cylinder 14 under the urge of the cylinder-lock spring 60.

Since the pressure exerted by spring 60 is relatively strong, cylinder lock 24 is driven with sufficient force to cam the cylinder 14 into fully indexed position in the manner described in the before-mentioned patent to Baker U.S. Pat. No. 4,001,962. However, the cylinder-lock spring of the Baker patent is necessarily much lighter than that of the present design and, consequently, cannot always be relied upon to cam the cartridge cylinder into position. Furthermore, as has been mentioned hereinbefore, the additional strength of cylinder-lock spring 60 permitted by the present invention is also an important safety factor in preventing accidental release of the cylinder due to an external blow, to which the revolver may be subjected when it is being carried or handled.

During the final increment of movement of trigger travel from the position shown in FIG. 2 to the firing position shown in FIG. 3, actuator 66 is carried bodily upward by the trigger until the portion adjacent pivot pin 34 engages the uppermost reaches of a curved indentation 78 in the under edge of cylinder lock 24. Such engagement under the pressure exerted by the shooter on the trigger positively drives the locking head 56 of the cylinder lock into one of the stop notches 58 and holds the cartridge cylinder rigidly in place as the hammer falls to discharge the cartridge in the chamber which is aligned with the barrel.

When the trigger 20 is released following discharge of the cartridge, it is returned to its rest position by the pressure of hammer spring 54 through the gear-plate 42 and gear-segment 40 in the manner disclosed in the aforesaid patent to Baker U.S. Pat. No. 3,996,686. During such return stroke the actuator 66 simply slides downward against the underside of cylinder lock 24 without re-engaging notch 68 until just before the trigger reaches its rest position. At this point the nose of actuator 66 comes into alignment again with notch 68 and is snapped into position by spring 70 for retracting cylinder lock 24 when the trigger is again pulled during double-action or when the hammer is cocked manually in single-action.

From the foregoing it will be apparent that cylinder lock 24 is not moved during the return stroke of the trigger and no springs are compressed by the trigger. Consequently, the only resistance to movement of the trigger back to its rest position is due to the slight drag of the actuator 66 against the cylinder lock 24 as it moves from the position shown in FIG. 2 to its position in FIG. 1.

What is claimed is:

1. In a double-action revolver having a cylinder rotatably mounted in a frame for intermittent movement into a plurality of positions and a trigger pivoted on a trigger pin on said frame for movement between a rest position and a firing position, a cylinder-locking device for maintaining said cylinder in each of its positions comprising a cylinder lock pivoted on said frame for movement into and out of a locking position with respect to said cylinder and resiliently urged into such locking position, an actuator for pivoting said cylinder lock out of its locking position in order to permit said cylinder to be indexed to another position, said actuator being mounted on said trigger for pivotal movement about a point located intermediate the trigger pin and the pivot point of said cylinder lock, said actuator having a nose portion for operative engagement with said cylinder lock, means for resiliently pivoting said nose portion of said actuator into engagement with said cylinder lock, said cylinder lock having a working surface disposed for co-operative engagement by said nose portion for pivoting said cylinder lock out of its locking position, the pivot point of said actuator being disposed, when said trigger is in its rest position, out of alignment with the pivot points of said trigger and cylinder lock in a direction such that upon movement of said trigger from its rest position, the pivot point of said actuator is moved toward alignment with said other pivot points thereby producing a toggle action, said nose portion of said actuator being disposed in an operative relationship with said working surface when said trigger is in its rest position for engagement with said working surface when said trigger is pulled, whereby said cylinder lock is pivoted by said actuator out of engagement with said cylinder during the initial travel of said trigger toward its firing position.

2. A cylinder-locking device as defined in claim 1, which further includes means for camming said nose portion out of engagement with said working surface during a subsequent portion of such trigger travel in order to permit said cylinder lock to re-engage said cylinder.

3. A cylinder-locking device as defined in claim 2, wherein said cam means comprises a hump on said cylinder lock adjacent said working surface and disposed for engagement with said actuator adjacent said nose portion upon pivotal movement of said trigger out of its rest position and of said cylinder lock out of locking engagement with said cylinder.

4. A cylinder-locking device as defined in claims 1, 2 or 3, wherein said cylinder lock is pivoted rearwardly of said actuator and extends forwardly thereof into operative relationship with said cylinder, the distance between the pivot points of said trigger and cylinder lock being less than the sum of the distances between (a) the pivot points of said trigger and said actuator, (b) the pivot point of said actuator and the extremity of said actuator nose portion, and (c) said working surface and the pivot point of said cylinder lock.

5. A cylinder-locking device as defined in claims 1, 2 or 3, wherein said cylinder lock is provided with a cylinder-engaging head portion remote from its pivot point, said working surface being located on said cylinder lock intermediate its pivot point and said cylinder-engaging head portion closer to the pivot point of said cylinder lock than to said head portion in order to magnify the movement of said head portion resulting from the movement of said actuator about the pivot point of said trigger.

6. A cylinder-locking device as defined in claims 1, 2 or 3, wherein said revolver includes a hammer mounted on a hammer pin and said cylinder lock is an elongated member pivoted adjacent one end to said hammer pin rearwardly of said actuator, said cylinder lock extending forwardly of said actuator into operative relationship with said cylinder.

7. A cylinder-locking device as defined in claims 1, 2 or 3, wherein said cylinder lock is an elongated member pivoted rearwardly of said actuator and extending forwardly into operative relationship with said cylinder, said actuator being movable bodily as said trigger approaches its firing position into engagement with said cylinder lock for positively driving said cylinder lock into locking engagement with said cylinder.

8. A cylinder-locking device as defined in claims 1, 2 or 3, wherein said revolver includes a hammer mounted on a hammer pin and said cylinder lock is pivoted on said hammer pin rearwardly of said actuator, said cylinder lock extending forwardly of said actuator into operative relationship with said cylinder, the distance between the pivot points of said trigger and cylinder lock being less than the sum of the distances between (a) the pivot points of said trigger and said actuator, (b) the pivot point of said actuator and the extremity of said actuator nose portion, and (c) said working surface and the pivot point of said cylinder lock.

* * * * *